US009872529B1

(12) United States Patent
Lindquist

(10) Patent No.: US 9,872,529 B1
(45) Date of Patent: Jan. 23, 2018

(54) GARMENT HAVING AN IMPROVED POCKET CONSTRUCTION FOR EASY RETRIEVAL OF ARTICLES FROM ITS POCKET

(71) Applicant: VF Jeanswear Limited Partnership, Greensboro, NC (US)

(72) Inventor: John Lindquist, Liberty, NC (US)

(73) Assignee: VF Jeanswear Limited Partnership, Greensboro, NC (US)

( * ) Notice: Subject to any disclaimer, the term of this patent is extended or adjusted under 35 U.S.C. 154(b) by 178 days.

(21) Appl. No.: 14/459,852

(22) Filed: Aug. 14, 2014

Related U.S. Application Data

(60) Provisional application No. 61/868,852, filed on Aug. 22, 2013.

(51) Int. Cl.

| | |
|---|---|
| ***A41D 3/08*** | (2006.01) |
| ***A41D 27/20*** | (2006.01) |
| ***A41D 1/02*** | (2006.01) |
| ***A41B 3/00*** | (2006.01) |
| ***A41B 1/08*** | (2006.01) |
| ***A41D 1/06*** | (2006.01) |
| ***A41D 1/14*** | (2006.01) |

(52) U.S. Cl.
CPC ..... *A41D 27/20* (2013.01); *A41B 1/08* (2013.01); *A41B 3/00* (2013.01); *A41D 1/02* (2013.01); *A41D 1/06* (2013.01); *A41D 1/14* (2013.01)

(58) Field of Classification Search
CPC ... A41D 13/0012; A41D 27/20; A41D 27/201
See application file for complete search history.

(56) References Cited

U.S. PATENT DOCUMENTS

| | | | | | |
|---|---|---|---|---|---|
| 2,732,560 | A | * | 1/1956 | Frederiksen | A41D 27/207 2/254 |
| 2,865,025 | A | * | 12/1958 | Hennessey | A41D 13/0012 2/94 |
| 3,193,842 | A | * | 7/1965 | Bell | A41D 27/20 150/147 |
| 3,320,620 | A | * | 5/1967 | Weidler | A41D 13/0012 2/250 |
| 3,374,508 | A | * | 3/1968 | Slimovitz | A41D 27/20 116/84 |
| 4,145,762 | A | * | 3/1979 | Wallach | A41D 27/20 2/238 |

(Continued)

OTHER PUBLICATIONS

"A Pulley System that Would Allow Hipsters to Easily Retrieve Their Phone from Tight Pants," http://beverynice.tumblr.com/post/49388669251/a-pulley-system-that-would-allow-hipster.., May 2013.

*Primary Examiner* — Sally Haden
(74) *Attorney, Agent, or Firm* — MacCord Mason PLLC

(57) ABSTRACT

A garment having an improved pocket construction for easy retrieval of articles from its pocket. The garment includes a garment body and at least one pocket attached to the garment body. The pocket includes a pull having one end affixed inside the pocket and at least a portion the pull extending outside of the pocket, whereby the pull is adapted to retrieve an article from the pocket in response to the wearer pulling the portion of the pull extending outside of the pocket. In one embodiment, the pocket further includes a two-part construction. The garment may further include a closure.

32 Claims, 8 Drawing Sheets

(56) References Cited

U.S. PATENT DOCUMENTS

| | | | | |
|---|---|---|---|---|
| 4,334,326 | A * | 6/1982 | Mallow | A44B 15/00 2/249 |
| 4,987,613 | A * | 1/1991 | Loverdi | A41D 1/08 2/22 |
| 6,289,524 | B1 * | 9/2001 | Wright | A41D 13/015 2/455 |
| 6,405,376 | B1 * | 6/2002 | Falk | A41D 13/0012 2/102 |
| 2006/0112476 | A1 * | 6/2006 | Todd | A41D 27/20 2/247 |
| 2013/0219589 | A1 * | 8/2013 | Jones | A41D 15/005 2/227 |
| 2014/0263485 | A1 * | 9/2014 | Catoe | A46B 5/02 223/42 |
| 2015/0074866 | A1 * | 3/2015 | Diakite | A41D 27/208 2/69 |
| 2015/0216244 | A1 * | 8/2015 | Noblitt | A41D 27/20 2/250 |

* cited by examiner

GARMENT HAVING AN IMPROVED POCKET CONSTRUCTION FOR EASY RETRIEVAL OF ARTICLES FROM ITS POCKET

BACKGROUND OF THE INVENTIONS (1) Field of the Inventions

The present inventions relate generally to apparel and, more particularly, to a garment having an improved pocket construction for easy retrieval of articles from its pocket.

(2) Related Art

In the apparel industry, there is usually a standard construction for a conventional bag-type pocket. While garment pockets may vary slightly, such pockets are traditionally made to carry items such as currency, keys and/or wallets. However, articles such as electronic devices, including cellular phones and gaming devices, have become widespread but are not conveniently carried in or well suited to the conventional garment pocket. Even pockets that have been fitted to accommodate the dimensions of the most commonplace articles, such as portable electronics, either secure the article too tightly preventing easy access to the article or do not secure it so that the article becomes lost in the pocket and not readily accessed and/or easily slips from the pocket.

In the past, many people have turned to carrying articles, such as their portable electronics, in holsters or specially designed clips that hook to a garment, such as on the belt or pants. Carrying articles this way keeps the article handy, however, requires an additional investment in a carrying case or carrying clip. Such carrying cases can be expensive and Applicant has found that some of the most convenient cases place the article in a vulnerable position where the article is often bumped and scratched, making the case prone to breakage. The alternative is to keep replacing broken cases, risking damage to the article, and/or to purchase one of the even more costly protective cases that often adds considerable weight to the article, and limits the convenience and ease of access to the article, defeating the purpose for the case in the first place.

Thus, there remains a need for a garment having an improved pocket construction for easy retrieval of articles from its pocket while, at the same time, may be adapted to retain articles in the pocket.

SUMMARY OF THE INVENTIONS

The present inventions are directed to a garment having an improved pocket construction for easy retrieval of articles from its pocket. The garment includes a garment body and at least one pocket attached to the garment body. The pocket includes a pull having one end affixed inside the pocket and at least a portion the pull extending outside of the pocket, whereby the pull is adapted to retrieve an article from the pocket in response to the wearer pulling the portion of the pull extending outside of the pocket. In one embodiment, the pocket further includes a two-part construction. The garment may further include a closure.

In one embodiment, the pull is formed of a non-elastic material. Also, the pull may be a flat cross section. In one embodiment, the pull is formed of fabric.

The garment may further include an aperture on the outer face of the pocket for receiving the portion of the pull extending outside of the pocket.

Also, the pull may include a stop at the distal end of the pull. In one embodiment, the stop may be an end stop. The end stop may be selected from the group consisting of tags, knobs, fabric seams, decorative objects, clasps, toggles and buttons. In another embodiment, the stop may be a frictional stop. The frictional stop may be selected from the group consisting of a rubber strip, elastomeric strip, fabric insert, raised strip and seam.

The garment may include a retractor attached to the pull and to the inside of the pocket. The retractor may be selected from the group consisting of an elastic strap, a rubber strip, a sprung metal, a sprung plastic, a weighted item, a mechanically retractable device and a spandex strip.

In one embodiment, the two-part pocket construction includes a first entry portion for receiving an article and a second lower portion for holding said article. The second lower portion for holding the article may be at a non-aligned angle with respect to the first entry portion for receiving the article and for forming a retention point.

In one embodiment, the garment may include a retainer located between the first entry portion for receiving the article and the second lower portion for holding the article. The retainer may be selected from the group consisting of an elastic band, a gathered seam, a raised edge, a bar tack, line tack, a frictional surface, a decorative stitching, rivets, eyelets, and decorative objects.

The pocket may be a patch pocket. The pocket may be a bag pocket.

In one embodiment, the closure includes a fly assembly. The fly assembly may be selected from the group consisting of zippers, buttons, hook and loop fasteners, snaps and string ties.

The garment may be selected from the group consisting of jeans, pants, culottes, shorts, skirts, shirts and jackets. The garment may further include a pair of legs attached to the garment body. The garment may also further including a pair of sleeves attached to the garment body. The garment may further include a collar attached to the garment body. The garment may further include a hood attached to the garment body.

Accordingly, one aspect of the present inventions is to provide a garment having an improved pocket construction for easy retrieval of articles from its pocket, the garment comprising: (a) a garment body; and (b) at least one pocket attached to the garment body, the pocket including a pull having one end affixed inside the pocket and at least a portion of the pull extending outside of the pocket, whereby the pull is adapted to retrieve an article from the pocket in response to the wearer pulling the portion of the pull extending outside of the pocket.

Another aspect of the present inventions is to provide a garment having an improved pocket construction for easy retrieval of articles from its pocket, the garment comprising: (a) a garment body; and (b) at least one pocket attached to the garment body, the pocket including a pull having one end affixed inside the pocket and at least a portion of the pull extending outside of the pocket, whereby the pull is adapted to retrieve an article from the pocket in response to the wearer pulling the portion of the pull extending outside of the pocket and wherein the pocket further includes a two-part construction.

Still another aspect of the present inventions is to provide a garment having an improved pocket construction for easy retrieval of articles from its pocket, the garment comprising: (a) a garment body; (b) at least one pocket attached to the garment body, the pocket including a pull having one end affixed inside the pocket and at least a portion the pull extending outside of the pocket, whereby the pull is adapted to retrieve an article from the pocket in response to the wearer pulling the portion of the pull extending outside of the pocket and wherein the pocket further includes a two-part construction; and (c) a closure.

These and other aspects of the present inventions will become apparent to those skilled in the art after a reading of the following description of the preferred embodiment when considered with the drawings.

DESCRIPTION OF THE PREFERRED EMBODIMENTS

Figure 1:
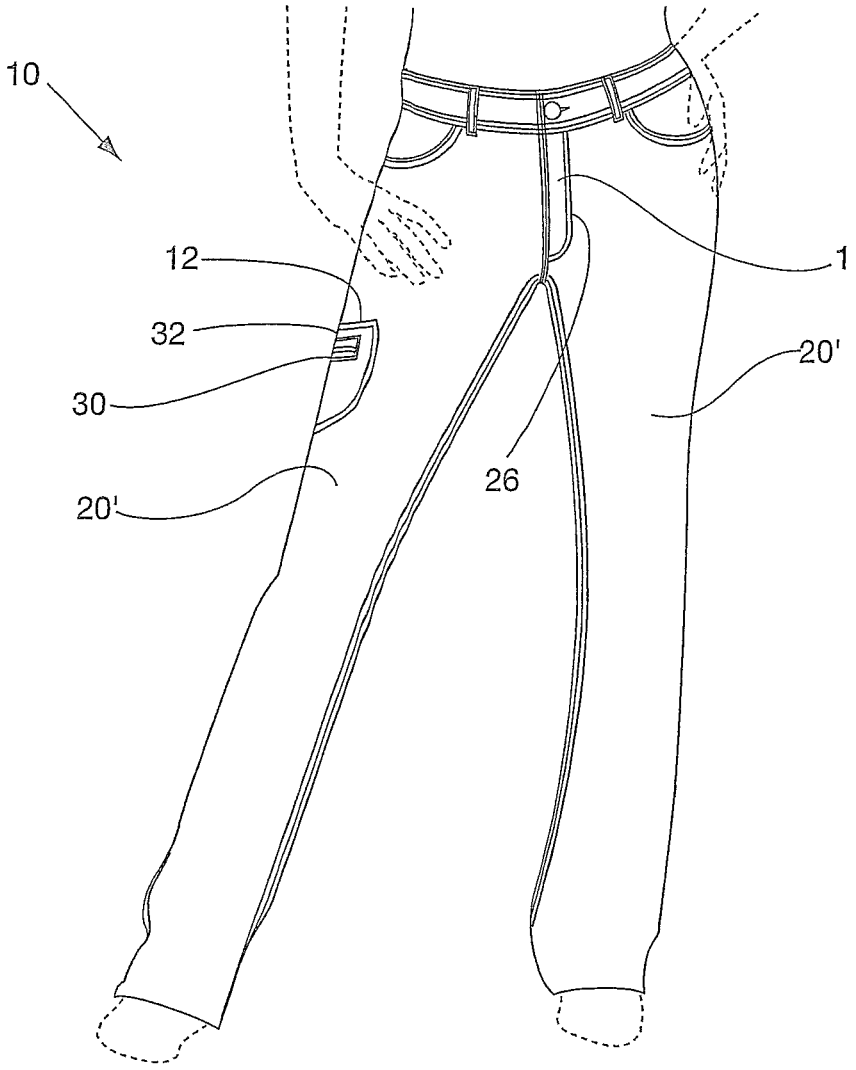
FIG. 1 is a front view of a garment constructed according to the present inventions as worn by the user.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Figure 2:
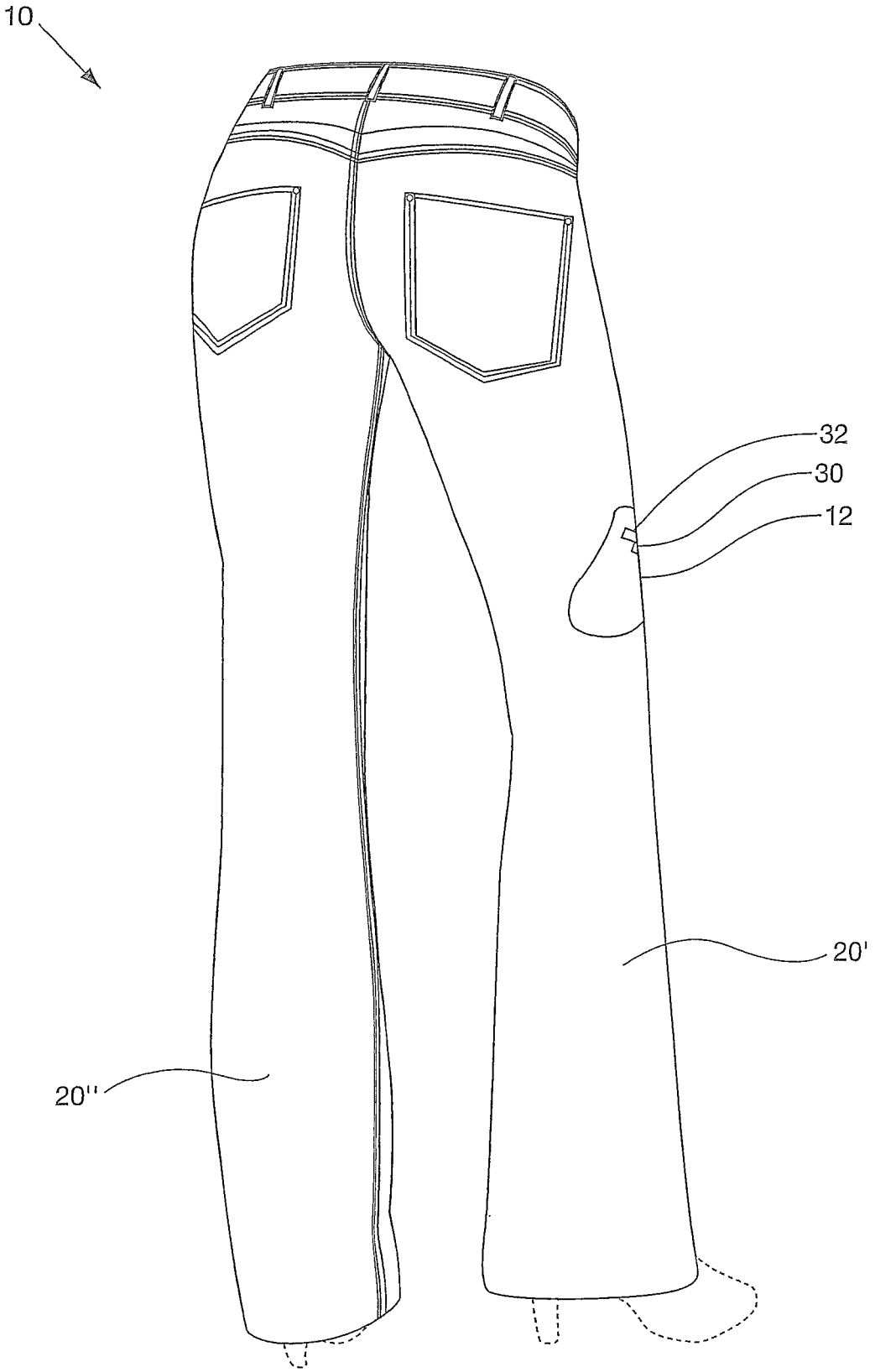
FIG. 2 is aback view of the garment shown in FIG. 1 as worn by a user.

Referring now to the drawings in general and FIGS. 1-2 in particular, it will be understood that the illustrations are for the purpose of describing a preferred embodiment of the inventions and are not intended to limit the inventions thereto. As best seen in FIGS. 1 and 2, a garment body, generally designated 10, is shown constructed according to one embodiment of inventions. FIGS. 1 and 2, for example, show a bottom garment. The garment body 10 includes an improved at least one pocket 12 for easy retrieval of articles from its pocket. In this embodiment, the at least one pocket 12 is attached to the garment body 10, for example, on one of the legs 20'. The pocket includes a pull 18 (shown in FIG. 5) having one end 16 affixed inside the pocket 12 and at least a portion of the pull extending outside of the pocket 12. The pull may be adapted to retrieve an article from the pocket in response to the wearer pulling the portion of the pull that extends outside of the pocket. The pull 18 may be attached to a stop 32, which prevents the pull 18 from retracting inside the pocket 12 through aperture 30.

Figure 3:
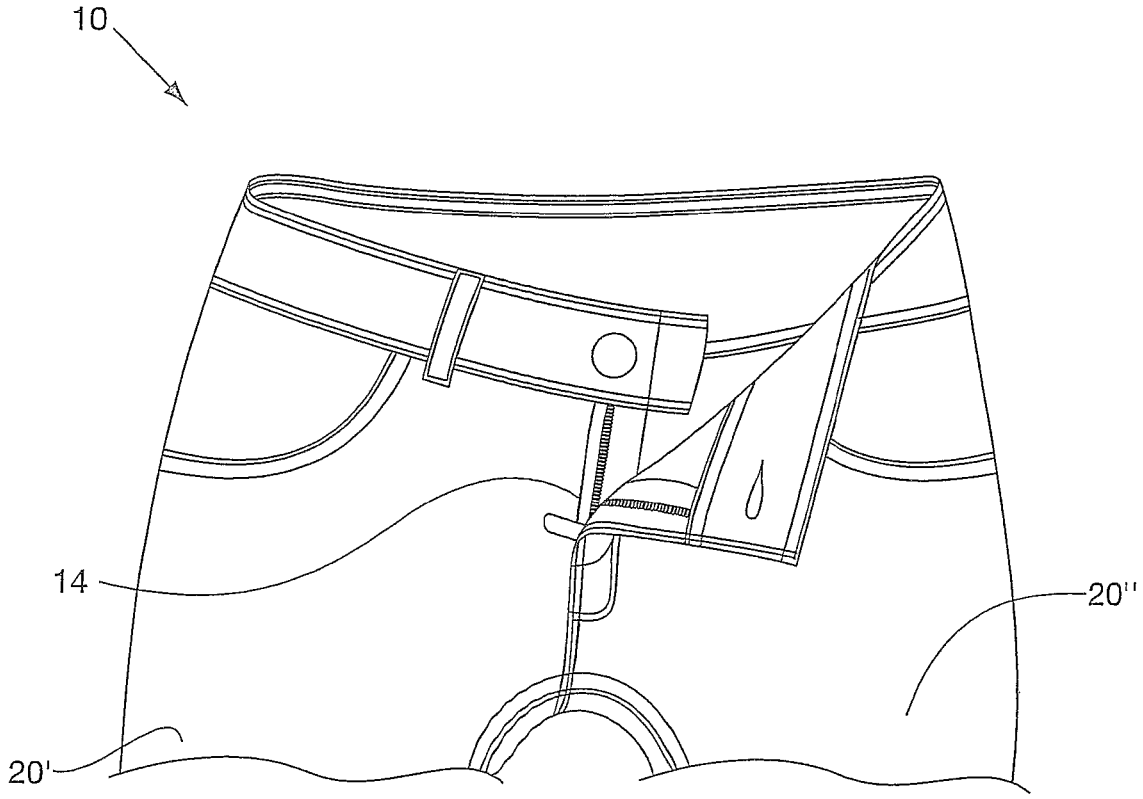
FIG. 3 is an enlarged front view of the garment shown in FIG. 1.

As shown in FIG. 3, another embodiment of the garment body 10 may include a closure 14. The closure 14 may include a fly assembly. The fly assembly, by way of example, may be selected from the group consisting of zippers, buttons, hook and loop fasteners, snaps and string ties. Those of ordinary skill in the art having the benefit of this disclosure will recognize other closure and fly assembly examples.

Figure 4:
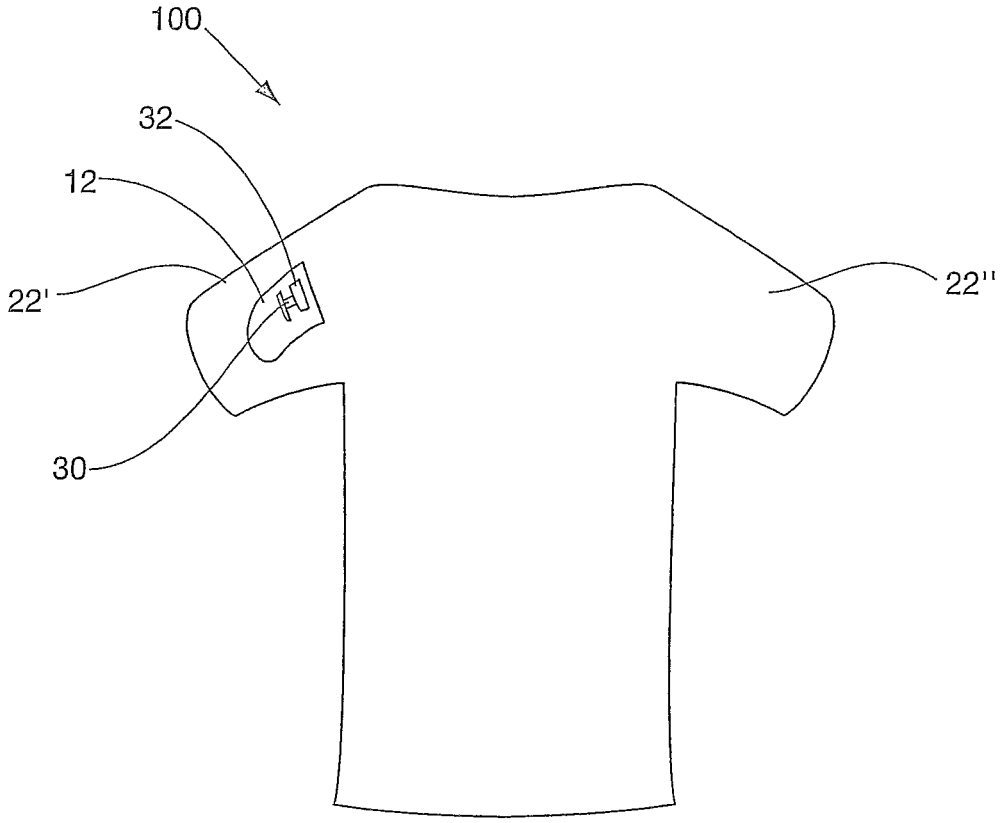
FIG. 4 is a front view of an alternative embodiment of a garment constructed according to the present inventions.

The embodiments from FIGS. 1-3 show that the garment may include a pair of legs attached to the garment body. FIG. 4 shows a garment body constructed according to another embodiment. This top garment shown in FIG. 4 includes a pair of sleeves attached to the garment body and at least one improved pocket 12 for convenient and efficient retrieval of articles from its pocket. In this embodiment, the at least one pocket 12 is attached to garment body 100, for example, on one of the sleeves 22'. Additional pockets may be included on either sleeve 22' or 22". The pocket 12 includes a pull 18 (shown in FIG. 5) having one end 16 affixed inside said pocket and at least a portion of the pull extending outside of the pocket 12 through aperture 30. The pull 18 is attached to a stop 32 that prevents the pull 18 from retracting inside the pocket 12 through aperture 30. In other embodiments, the garment may further include a collar attached to the garment body or further include a hood attached to the garment body.

FIGS. 5-8 illustrates one embodiment of a pocket constructed for easy retrieval of articles from within the pocket. As an example, the garment pocket 12 may be constructed as a patch pocket or bag pocket. Typically, the garment pocket 12 includes a two-part construction. As shown, the two-part pocket construction includes a first entry portion 36 for receiving an article and a second lower portion 40 for retaining the article. The two-part construction of the pocket is useful for helping prevent the article from slipping outside the pocket by way of an opening in the first entry portion of the pocket 36. By way of example, if the pocket is located on a garment body, such as a pant leg, the first entry portion 36 may be aligned parallel down the pant leg (as shown in FIG. 1). In a pocket with a one-part construction, if the pocket were solely parallel to the pant leg, then if a user placed an article in the pocket and subsequently sat down in a chair, the article would be prone to slipping out of said pocket. Therefore, Applicant has unexpectedly discovered that a two-part construction helps to prevent such slippage by positioning a second lower portion 40 at a non-aligned angle with respect to the first entry portion 36. This alignment reduces article slippage by requiring that the article having to travel two different, i.e. non-parallel, path lines to exit the pocket. The non-aligned angle between the first and second entry portions may further form a retention point 41 to hold the article. The retention point 41 secures the article in place independent of the orientation of a donned article. For instance, the retention point 41 at which the article is held reduces the risk of said article slipping out of the pocket when the entire pocket changes its angle depending on the user's actions.

Figure 6:
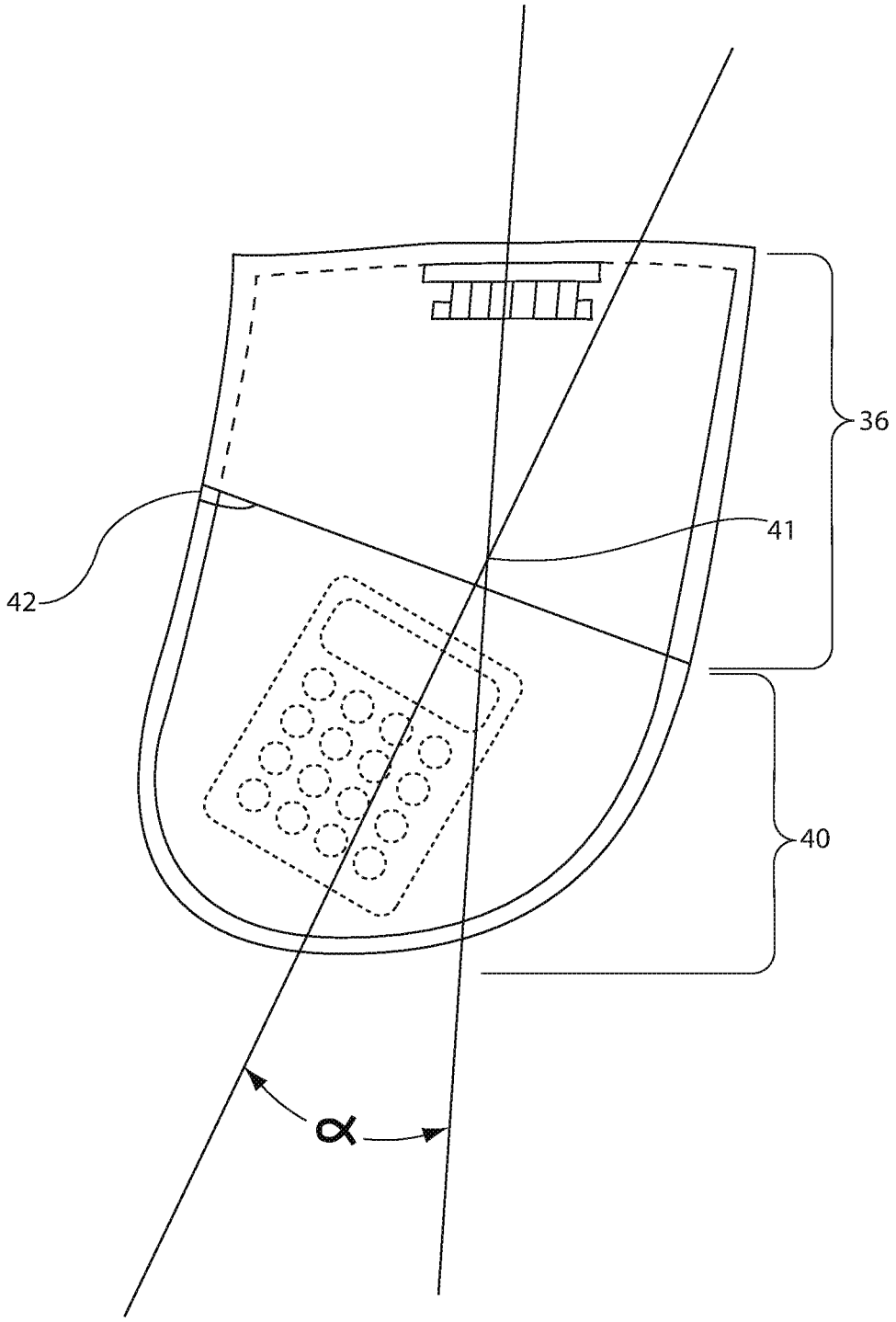
FIG. 6 is a semi-transparent view of a pocket containing an article according to one embodiment of the present inventions.

In another embodiment, the pocket 12 may also include a retainer 42, for example as shown in FIG. 6, located between the first entry portion for receiving the article and the second lower portion for holding the article. The retainer may be included to further prevent the article from slipping outside the pocket. The retainer could be an item that provides a physical barrier to prevent the article from slipping out. By way of example, the retainer may be an elastic band where the user can comfortably place the article in the pocket, yet the elastic nature of the retainer physically prevents the article from leaving the pocket unless retrieved by the user via utilizing the pull 18 or directly accessing the article. The retainer could also be a gathered seam, a raised edge, bar tags, line tags, decorative stitching, rivets, islets, rhinestones or the like. Alternatively, the retainer may be a frictional surface that resists article movement within the pocket.

Figure 8:
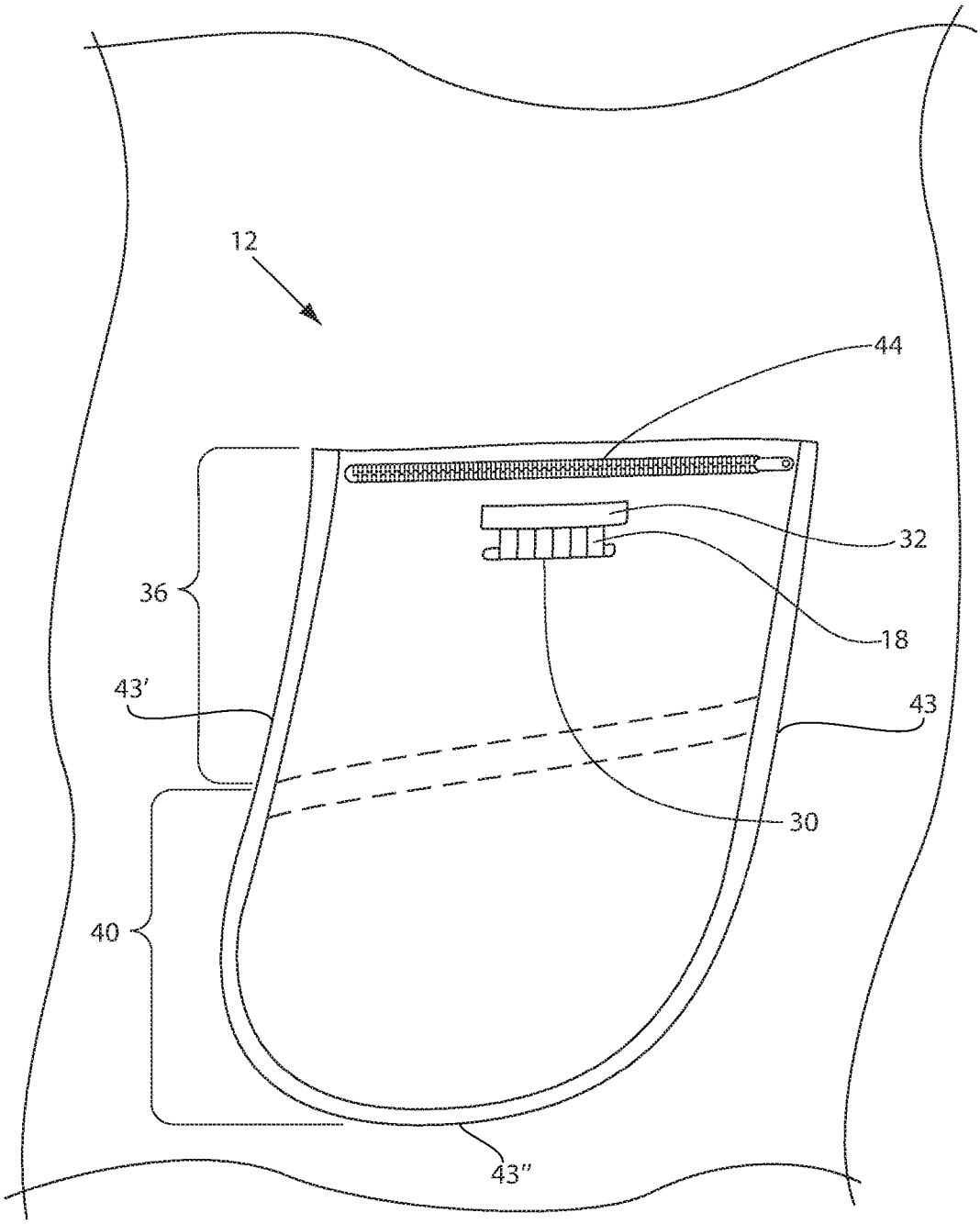
FIG. 8 is another exterior view of a pocket according to one embodiment of the present inventions.

The pocket 12 may include a pocket closure 44 to prevent unwanted article slippage, wherein the closure may be formed via a flap, zipper, tie string, hook and loop, snap, or alternatively, one or more buttons. FIG. 8 illustrates one embodiment of the pocket closure in combination with a two-part pocket construction. In another embodiment, the pocket closure could be used in combination with a two-part pocket construction and a retainer, where multiple components are employed to inhibit the article from unintentionally exiting the pocket. Three physical barriers could therefore be present at three different location's (i.e., at the retention point, retainer, and pocket closure) providing multiple checkpoints to ensure that the article does not slip out of the user's pocket.

The pocket 12 includes a pull 18 having one end 16 affixed inside the pocket 12 and at least a portion of the pull extending outside of the pocket 12. The pull 18 may be formed of fabric, elastic material, non-elastic material or a mixture of elastic and non-elastic materials. The pull may be adapted to retrieve an article from the pocket in response to the wearer pulling the portion of the pull that extends outside of the pocket. By providing a pull 18, the user can easily retrieve an article from the pocket without having to manually search for it within the pocket and maneuver it out. In one embodiment, the pull 18 may be constructed as a flat cross section. In this embodiment, the pull includes a cradle 19 that rests in a retracted position that cradles at least the bottom portion of an article. Prior to placing the article in pocket 12, the pull may be in a retracted or extended position. If the pull is in an extended position, the pull 18 moves from the extended position into a retracted position as the user inserts the article into the pocket. When the user desires to retrieve the article from the pocket, the user extends the pull 18, which then lifts the article out of the pocket.

Figure 5:
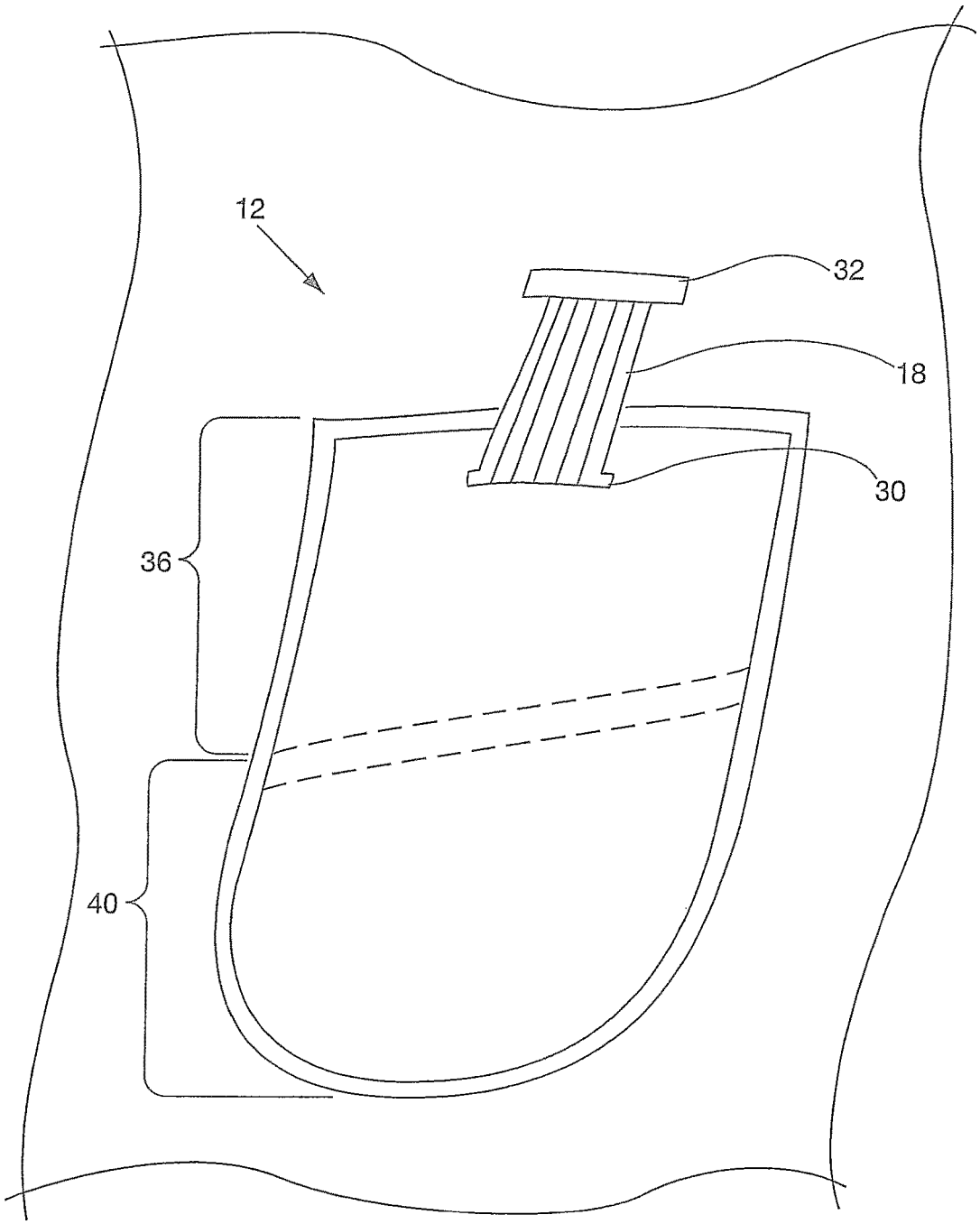
FIG. 5 is an exterior view illustrating the details of a pocket according to one embodiment of the present inventions.

The pocket 12 may include an aperture 30 on its outer face for receiving the portion of pull 18 that extends outside of said pocket. Aperture 30 facilitates user access to the pull 18 by reducing the risk that the pull falls into the pocket 12. As seen in FIGS. 5, 6 and 8, the pull 18 may be attached to a stop 32 at its distal end, which further prevents the pull 18 from retracting inside the pocket 12 through aperture 30. The stop 32 may be comprised of an end stop or a frictional stop. An end stop, by way of example, may be in the form of tags, knobs, fabric seams, decorative objects, clasps, toggles or leather. A frictional stop, by way of example, could be composed of rubber strip, elastic, fibrous materials, and synthetic materials.

Figure 7:
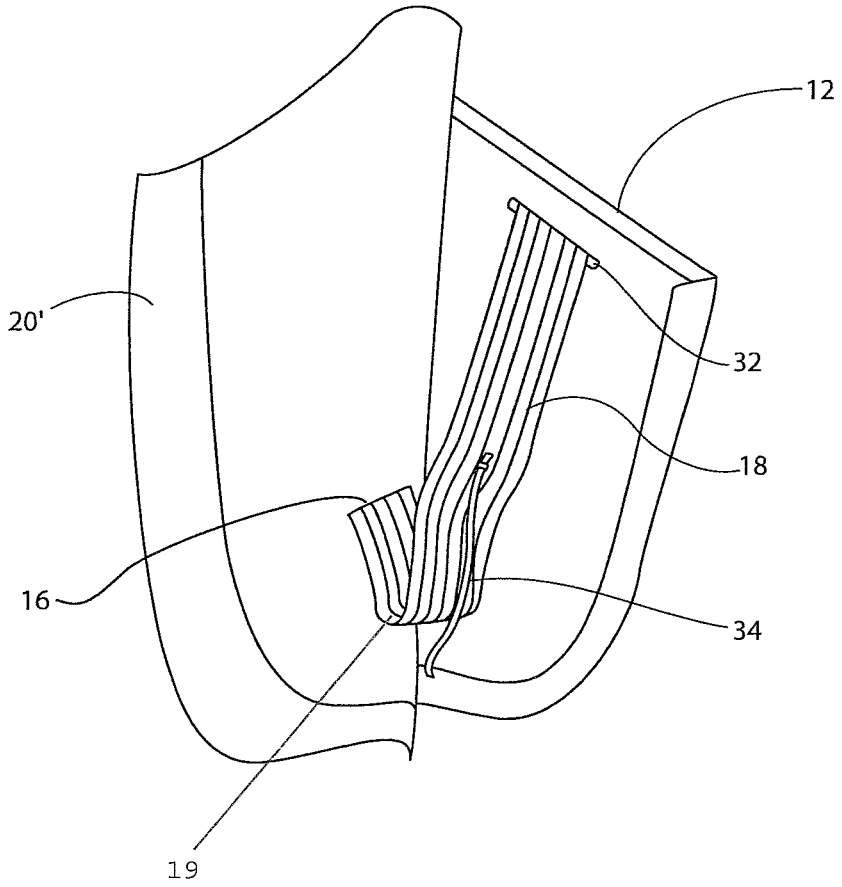
FIG. 7 is an interior view of a pocket according to one embodiment of the present inventions.

In one embodiment, the pull 18 may be affixed to the interior of the pocket via a retractor 34 as shown in FIG. 7. The retractor is adapted to retract a portion of the pull in response to the wearer releasing the pull 12 after initially pulling said pull. Adding a retractor 34 to the pull 18 automatically resets the pull to its initial retracted position after being pulled by the user so that the user does not have to manually reset the pull from its extended position. The retractor 34, by way of example, may be an elastic strap, rubber strap, sprung metal, weighted item, spandex strap, a blend of organic/non-organic material used as a strap, a mechanically retractable device and the like.

Certain modifications and improvements will occur to those skilled in the art upon a reading of the foregoing description. By way of example, while one embodiment shown in the above disclosure illustrates a garment that may include jeans, pants, culottes and shorts, it should be clear that the present inventions may be modified to further include skirts, shirts and jackets. Minimum components would entail, pocketing fabric material, pocket facing material and means to attach the parts such as thread. Other components could be varying types of fabric, printed or colored pocketing fabric piecing, vary the shape or size of the pocket facing part or pocketing. In addition, the inventions may apply to garments having a single ply right fly. Other components could include a two-part pocket construction, a retractor attached to the pull and the inside of the pocket, an aperture for the distal end of the pull to extend outside the pocket, and a stop at the distal end of the pull to prevent the pull from retracting completely inside the pocket. It should be understood that all such modifications and improvements have been deleted herein for the sake of conciseness and readability but are properly within the scope of the following claims.

I claim:

1. A garment having an improved pocket construction for easy retrieval of articles from a garment pocket said garment comprising:

(a) a garment body; and (b) at least one pocket attached to said garment body forming a pocket space between said garment body and said pocket, said pocket including a pull having one end affixed inside said pocket space to said garment body and an opposite end of said pull extending through an aperture formed in the pocket to an exterior of the pocket, such that said pull spans the pocket space between said pocket and said garment body forming a u-shaped cradle, the one end attaching to the garment at a first location spaced apart from edges of the pocket and the aperture being at a second location, the first location being lower in elevation than the second location, a middle portion of the u-shaped cradle between said one end and said opposite end, said middle portion being at a third location that is lower in elevation than the first location and the second location, wherein said pull is adapted to retrieve an article from said pocket by way of said cradle in response to a wearer pulling said opposite end of said pull.

2. The garment according to claim 1, further including a closure.

3. The garment according to claim 1, further including a pair of legs attached to said garment body.

4. The garment according to claim 1, further including a pair of sleeves attached to said garment body.

5. A garment having an improved pocket construction for easy retrieval of articles from a garment pocket, said garment comprising:

(a) a garment body; and (b) at least one pocket attached to said garment body, said pocket including a pull spanning a space between the garment and the pocket, and having one end terminating inside said pocket and affixed to said garment at a medial position between a top of the pocket and a bottom of the pocket and an opposite end of said pull extending through an aperture formed in the pocket and terminating outside of said pocket, said medial position being lower in elevation than said aperture, a middle pull portion located between the one end and the opposite end, said middle pull portion resting in a retracted position lower in elevation than said one end and said opposite end and having a cradle in the middle pull portion, the cradle being encased inside the pocket between the garment body and the pocket for cradling an object, said cradle formed between the one end affixed to said garment and the opposite end extending outside the pocket, said cradle adapted to lift an article from said pocket in response to a wearer pulling said opposite end extending outside of said pocket, (c) wherein said pocket further includes a two-part construction, wherein a first entry portion is non-symmetrical with a second lower portion of said pocket.

6. The garment according to claim 5, wherein said pull is formed of a non-elastic material.

7. The garment according to claim 5, wherein said pull has a flat cross section.

8. The garment according to claim 5, wherein said pull is formed of fabric.

9. The garment according to claim 5, wherein said pull includes a stop at the opposite end of said pull.

10. The garment according to claim 9, wherein said stop is an end stop.

11. The garment according to claim 5 further including a retractor attached to said pull and to an inside of said pocket.

12. The garment according to claim 5, wherein said first entry portion is configured at a non-aligned angle from said second lower portion such that said first entry portion is configured to receive said article and said second lower portion is configured to hold said article.

13. The garment according to claim 12, wherein said second lower portion for holding said article is at a non-aligned angle with respect to said first entry portion for receiving said article.

14. The garment according to claim 13, wherein said non-aligned angle forms a retention point.

15. The garment according to claim 12 further including a retainer located between said first entry portion for receiving said article and said second lower portion for holding said article.

16. The garment according to claim 5, wherein said pocket is a patch pocket.

17. The garment according to claim 5, wherein said pocket is a bag pocket.

18. A garment having an improved pocket construction for easy retrieval of articles from a garment pocket, said garment comprising:

(a) a garment body;

(b) at least one pocket attached to said garment body, said pocket including a pull having one end affixed to said garment inside the pocket at a substantially medial position of said pocket between a top of the pocket and a bottom of the pocket, spaced apart from the top of the pocket and the bottom of the pocket, and an opposite pull end extending through a pocket material to an outside of said pocket directly through a pocket aperture that is formed as a hole through a face of the pocket and is located at a higher position than said one end affixed inside said pocket, wherein a bend in a length of the pull forms a cradle for receiving said articles within said pocket between said one end and said opposite pull end, wherein the bend spans a pocket space between the garment and an inside of the pocket at a lower elevation than said substantially medial position and said higher position, wherein said pull is adapted to retrieve an article from said pocket in response to a wearer pulling said opposite pull end extending outside of said pocket and wherein said pocket further includes a two-part construction, wherein a first entry portion is non-symmetrical with a second lower portion of said pocket; and (c) a closure.

19. The garment according to claim 18, further including a pair of legs attached to said garment body.

20. The garment according to claim 18, further including a pair of sleeves attached to said garment body.

21. The garment according to claim 18, wherein said pull is formed of a non-elastic material.

22. The garment according to claim 18, wherein said pull has a flat cross section.

23. The garment according to claim 18, wherein said pull is formed of fabric.

24. The garment according to claim 18, wherein said pull includes a stop at the opposite pull end of said pull.

25. The garment according to claim 24, wherein said stop is an end stop.

26. The garment according to claim 18 further including a retractor attached to said pull and to an inside of said pocket.

27. The garment according to claim 18, wherein said two-part pocket construction includes said first entry portion for receiving said article and said second lower portion for holding said article.

28. The garment according to claim 27, wherein said second lower portion for holding said article is at a non-aligned angle with respect to said first entry portion for receiving said article.

29. The garment according to claim 28, wherein said non-aligned angle forms a retention point.

30. The garment according to claim 27 further including a retainer located between said first entry portion for receiving said article and said second lower portion for holding said article.

31. The garment according to claim 18, wherein said pocket is a patch pocket.

32. The garment according to claim 18, wherein said pocket is a bag pocket.

* * * * *